US010243246B2

(12) United States Patent
Laighton et al.

(10) Patent No.: US 10,243,246 B2
(45) Date of Patent: Mar. 26, 2019

(54) PHASE SHIFTER INCLUDING A BRANCHLINE COUPLER HAVING PHASE ADJUSTING SECTIONS FORMED BY CONNECTABLE CONDUCTIVE PADS

(71) Applicant: Raytheon Company, Waltham, MA (US)

(72) Inventors: Christopher M. Laighton, Boxborough, MA (US); Susan C. Trulli, Lexington, MA (US); Elicia K. Harper, Chelsea, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 15/659,877

(22) Filed: Jul. 26, 2017

(65) Prior Publication Data

US 2019/0036189 A1 Jan. 31, 2019

(51) Int. Cl.
*H01P 1/18* (2006.01)
*H01P 11/00* (2006.01)

(52) U.S. Cl.
CPC ..... *H01P 1/184* (2013.01); *H01P 11/00* (2013.01)

(58) Field of Classification Search
CPC .. H01P 1/185; H01P 1/18; H01P 1/184; H01P 11/00
USPC ..... 333/164
See application file for complete search history.

(56) References Cited

U.S. PATENT DOCUMENTS 4,751,453 A * 6/1988 Foti ..... H01P 1/185 323/212
8,177,348 B2 5/2012 Sidhu et al.
2016/0014906 A1 1/2016 Ilic et al.

OTHER PUBLICATIONS

Tehrani et al.; Inkjet-Printed 3D Interconnects for Millimeter-Wave System-on-Package Solutions. 2016 IEEE MTT-S International Microwave Symposium (IMS), San Francisco, CA; Jan. 1, 2016; 4 pages.
Nishant Gupta, Raghuvir Tomar, A Low-Loss Voltage-Controlled Analog Phase-Shifter Using Branchline Coupler and Varactor Diodes, The LNM Institute of Information Technology and Natel Engineering Co., Inc., IEEE, Jul. 2, 2007, (2 pages).
J. Piotr Starski, Optimization of the Matching Network for a Hybrid Coupler Phase Shifter, IEEE, vol. MTT-25, No. 8, Aug. 1977, pp. 662-666 (5 pages).

(Continued)

*Primary Examiner* — Benny T Lee
(74) *Attorney, Agent, or Firm* — Daly, Crowley, Mofford & Durkee, LLP

(57) ABSTRACT

A phase shifter is formed by providing a branchline coupler having a pair of phase adjusting sections. Each one of the phase adjusting sections is coupled to a corresponding one of a pair of shunt transmission line sections of the branchline coupler. Each one of the pair of phase adjusting sections includes: first and second conductive pads are disposed on the surface of a substrate having a gap between them; one of the pads being connected to a ground plane conductor on a bottom surface of the substrate. A series of conductive layer segment is sequentially written on the surface of the substrate in the gap electrically connected to sidewalls of the first and second pads. Phase shift through the phase shifter is measured after each one of the segments is written. The writing process is terminated when the measuring detects a predetermined phase shift through the phase shifter.

4 Claims, 8 Drawing Sheets

(56) References Cited

OTHER PUBLICATIONS

F. Ferrero, C. Luxey, G. Jacquemod, R. Staraj, G. Kossiavas, V.Fusco, Reconfigurable phased-arrays based on hybrid couplers in reflection mode, Université de Nice-Sophia Antipolis, IEEE Feb. 13, 2017, (4 pages).

M.H. Kori, Me, Prof. S. Mahapatra, PhD., Integral analysis of hybrid coupled semiconductor phase shifters, IEEE, vol. 134, Pt. H, No. 2, Apr. 1987, pp. 156-162 (7 pages).

Ozan Dogan Gurbuz, Gabriel M. Rebeiz, A. 1.6-2.3-GHz RF MEMS Reconfigurabie Quadrature Coupler and Its Application to a 300 Reflective-Type Phase Shifter, IEEE, vol. 63, No. 2, Feb. 2015, pp. 414-421 (8 pages).

* cited by examiner

PHASE SHIFTER INCLUDING A BRANCHLINE COUPLER HAVING PHASE ADJUSTING SECTIONS FORMED BY CONNECTABLE CONDUCTIVE PADS

TECHNICAL FIELD

This disclosure relates generally to analog phase shifters and more particularly to phase adjustable analog phase shifters.

BACKGROUND

As is known in the art, one type of analog phase shifter includes a branchline coupler. One such branchline coupler, sometimes also referred to as a reflective coupler or a shunt hybrid combiner, Quadrature Hybrid, having an input port (Input 1), a pair of output ports (Output 2, Output 3) and an isolated port (Isolate 4), is shown in FIG. 1 to include a pair of main transmission lines and a pair of shunt transmission lines. One analog phase shifter, (FIG. 2) that includes a branchline coupler having a pair of phase adjusting sections is described in a paper entitled "Integral analysis of hybrid coupler semiconductor phase shifters" by Kori et al, IEE Proceedings, vol. 134, Pt.H. No. 2. April 1987.

One technique used to adjust phase shift of the branchline coupler type phase shifter is to connect a phase adjusting section connected to each one of the pair of shunt transmission lines as described in a paper entitled "A Low-Loss Voltage-Controlled Analog Phase-Shifter Using Branchline Coupler and Varactor Diodes" by Gupta et al., (Gupta, Nishant, Raghuvir Tomar, and Prakash Bhartia. "A low-loss voltage-controlled analog phase-shifter using branchline coupler and varactor diodes." *Microwave and Millimeter Wave Technology,* 2007. *ICMMT'07. International Conference on*. IEEE, 2007). In that paper a pair of varactor diodes is controlled by voltages to adjust the phase shift provided by the phase shifter. Another branchline coupler type phase shifter having a phase adjusting section connected to each one of the pair of shunt transmission lines is shown in FIG. 3A. In that paper the phase adjusting sections each includes a pair of conductors separated one from and the other; one of the conductors being connected to a ground plane conductor on the bottom of a substrate by ground vias (FIGS. 3A and 3B). The two conductors are connected by a series of bridging, spaced bond wires, as shown. With an input signal applied at an input the phase at an output is measured and the bond wires are removed one at a time, as shown in FIG. 3B, to thereby change the electrical length of the path through the phase adjusting sections to ground until the desired phase shift is obtained; FIG. 3B showing several of the bond wires removed from the branchline coupler type phase shifter of FIG. 3A.

SUMMARY OF THE INVENTION

In accordance with present disclosure, a method is provided to forming a phase shifter, comprising providing a branchline coupler on an upper surface of a substrate with a pair of phase adjusting section, each one of the phase adjusting sections is coupled to a corresponding one of a pair of shunt transmission line sections of the branchline coupler. Each one of the pair of phase adjusting sections includes: a first conductive pad disposed on the upper surface of a substrate of the branchline coupler and is connected to the ground plane conductor on a bottom surface of the substrate. A second conductive pad is disposed on the upper surface of the substrate, the first conductive pad and the second conductive pad being separated by a gap. The method includes sequentially depositing a series of conductive layer segments on the upper surface of the substrate in the gap electrically connected to sidewalls of the first conductive pad and the second conductive pad. Measuring phase shift through the phase shifter after each one of the segments is deposited. The depositing process is terminated when the measuring detects a predetermined phase shift through the phase shifter.

With such a method, the use of additive manufacturing (printing or depositing) allows for fine levels of phase tuning.

In one embodiment, a phase shifter is provided having a branchline coupler; and a pair of phase adjusting sections, each one of the phase adjusting sections being coupled to a corresponding one of a pair of shunt transmission line sections of the branchline coupler, Each one of the pair of phase adjusting sections comprises; a first conductive pad disposed on the upper surface of a substrate of the branchline coupler and connected to a ground plane conductor on a bottom surface of the substrate; a second conductive pad disposed on the upper surface of the substrate, the first conductive pad and the second conductive pad being separated by a gap; and a conductive layer disposed on the upper surface of the substrate in the gap and having sidewalls electrically connected to sidewalls of the first conductive pad and the second conductive pad, such conductive layer having a length selected to provide a predetermined phase shift to a signal passing between the input port and the output port; the conductive layer being a material different from the first conductive pad and the second conductive pad.

The details of one or more embodiments of the disclosure are set forth in the accompanying drawings and the description below. Other features, objects, and advantages of the disclosure will be apparent from the description and drawings, and from the claims.

BRIEF DESCRIPTION OF DRAWINGS

Like reference symbols in the various drawings indicate like elements.

DETAILED DESCRIPTION OF THE INVENTION

Figure 1:
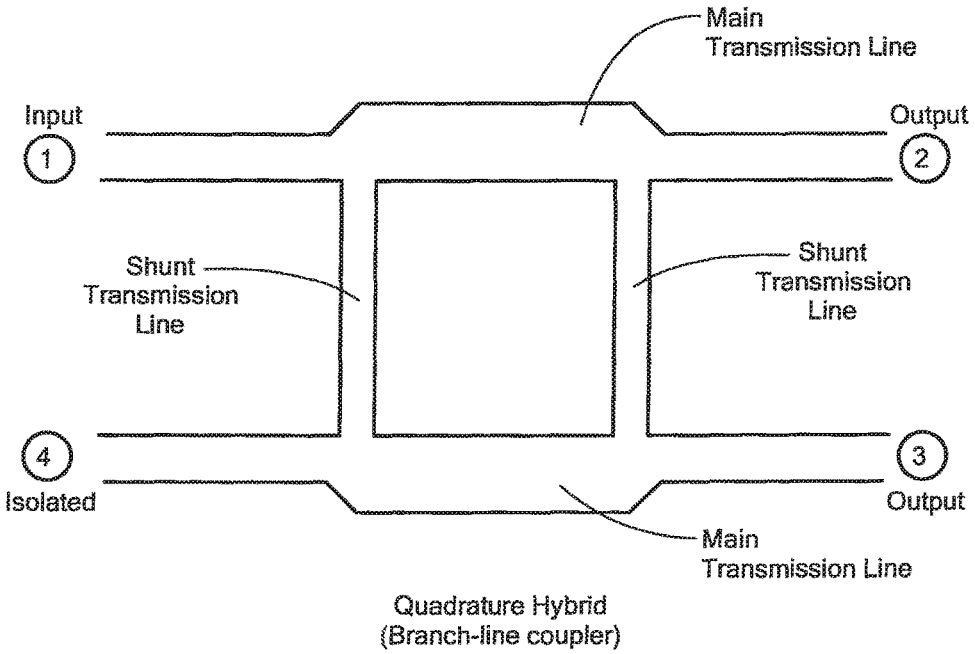
FIG. 1 PRIOR ART
FIG. 1 is a schematic diagram of a branchline coupler according to the PRIOR ART.
Figure 2:
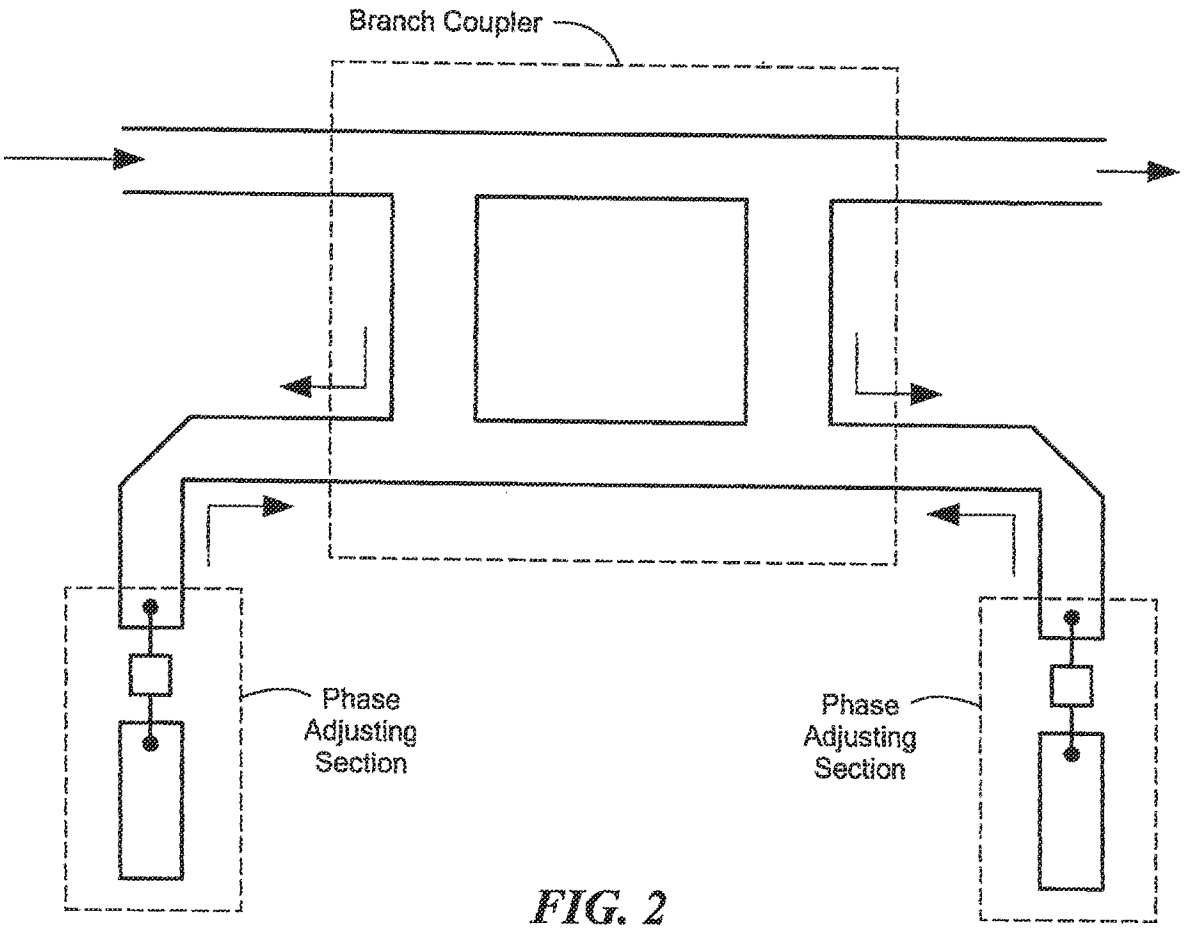
FIG. 2 PRIOR ART
FIG. 2 is a schematic diagram of a phase shifter using a branchline coupler according to the PRIOR ART.
Figure 3A:
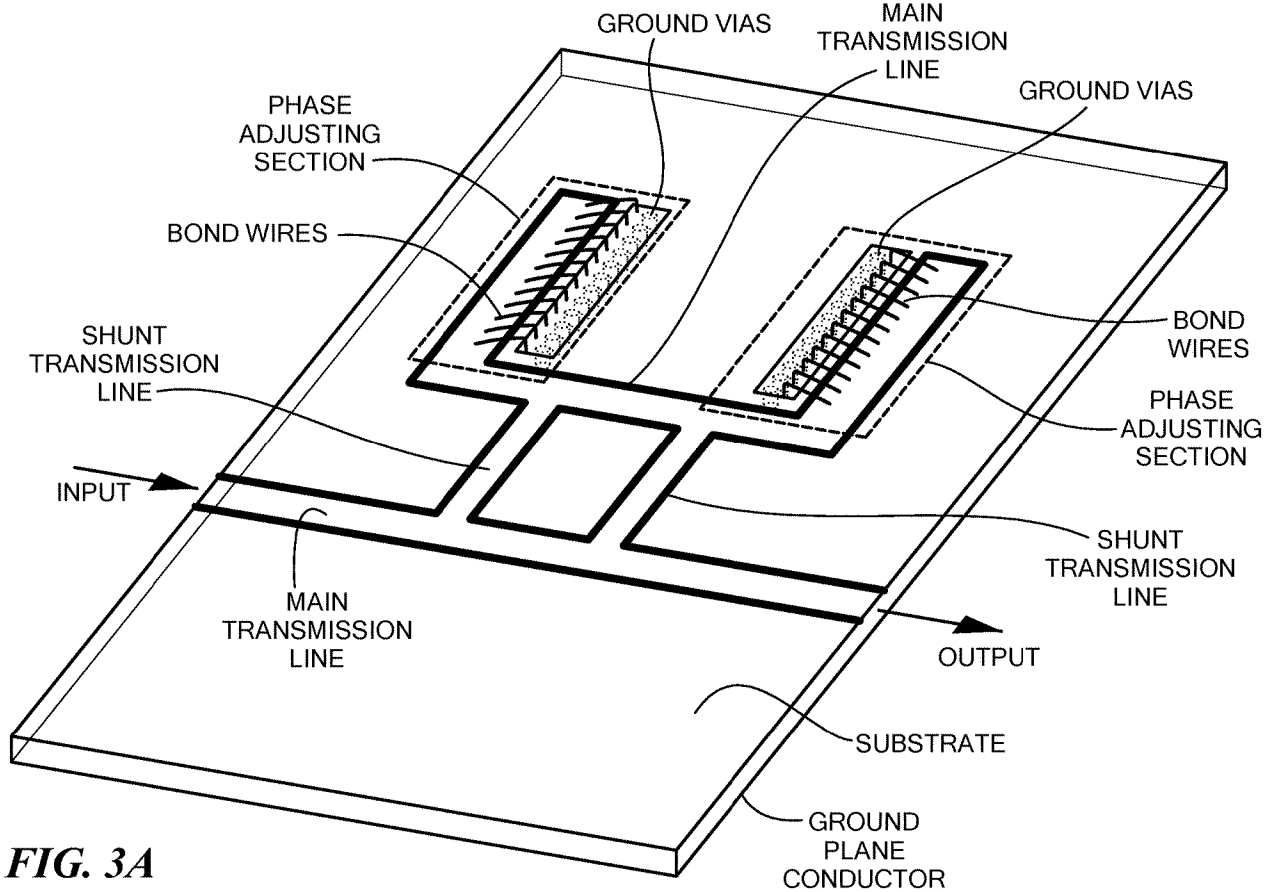
FIG. 3A PRIOR ART
FIGS. 3A and 3B are perspective views of a phase shifter using a branchline coupler according to the PRIOR ART at various stages in the fabrication thereof according to the PRIOR ART.
Figure 3B:
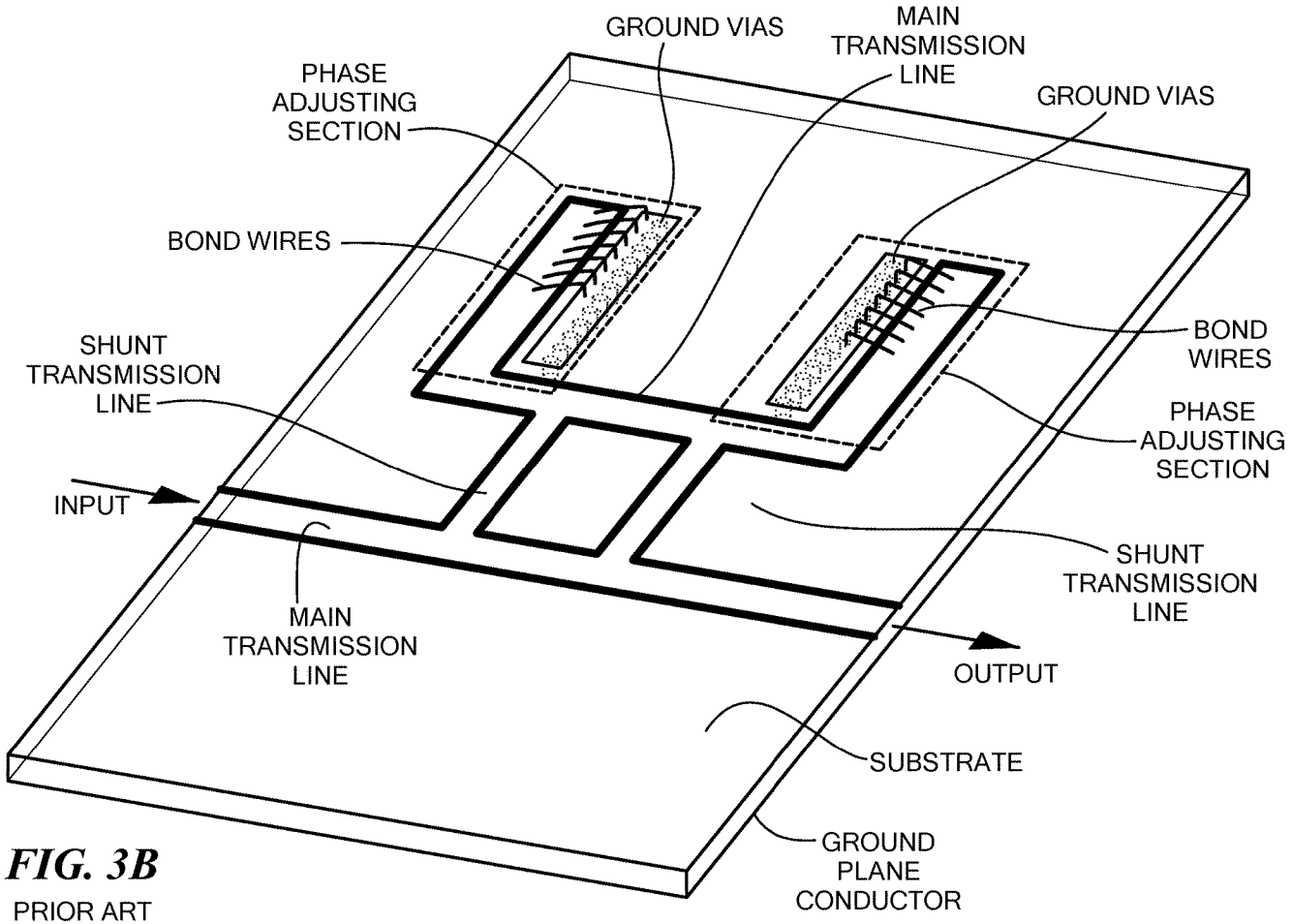
FIG. 3B PRIOR ART
Figure 4:
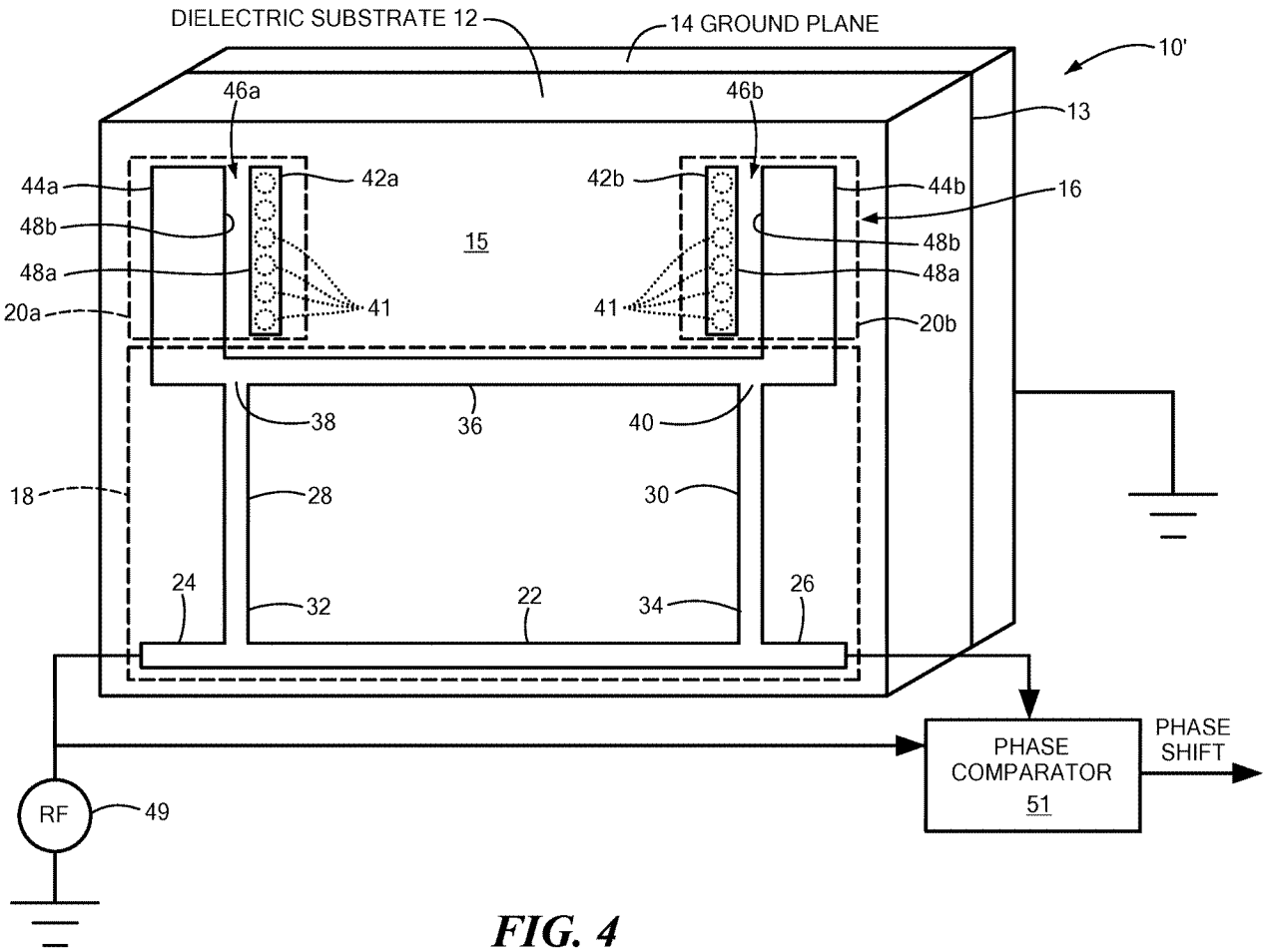
FIG. 4 is a perspective view sketch of a partially formed phase shifter at one stage in the fabrication thereof according to the disclosure.

Referring now to FIG. 4, a partially complete phase shifter 10' is shown having: a dielectric substrate 12 is provided having a ground plane conductor 14, here for example gold, on a bottom surface 13 of the substrate 12 and a lithographically-etched pattern of strip conductors 16, here for example gold, on an upper surface 15 of the substrate, as shown; the pattern strip conductors 16, substrate 12 as shown in FIG. 4 and ground plane conductor 14 being arranged to form: a branchline coupler 18, here for example, a microstrip branchline coupler, connected to a pair of partially formed phase adjusting sections 20*a*, 20*b*, as shown. The branchline coupler includes: a first main transmission line 22 having an input end 24 and an output end 26; a pair of shunt transmission lines 28, 30, one of the pair of shunt transmission lines 28, 30, here shunt transmission line 28 having an input end 32 connected to the input end 24 of the first main transmission line 22 and the other of the pair of shunt transmission lines 28, 30, here shunt transmission line 30 having an input end 34 connected to the output end 26 of the first main transmission line 22; and a second main transmission line 36 coupled between output ends 38, 40 of the pair of shunt transmission lines. The pair of partially formed phase adjusting sections 20*a*, 20*b* are coupled to the output ends 38, 40, respectively, of a corresponding one of the pair of shunt transmission line sections 28, 30, respectively, as shown.

Each one of the pair of phase adjusting sections 20*a*, 20*b* comprises; a first conductive pad 42*a*, 42*b*, respectively, as shown, disposed on the upper surface 15 of the substrate 12 and connected to the ground plane conductor 14 through one or more electrically conductive vias 41 passing through the substrate 12; a second conductive pad 44*a*, 44*b*, respectively, as shown, disposed on the upper surface 15 of the substrate 12 and connected to the output ends 38, 40, respectively, of a corresponding one of the pair of shunt transmission line sections 28, 30, respectively, as shown. The first conductive pad 42*a* and the second conductive pad 44*a* have a gap 46*a* between them and the first conductive pad 42*b* and the second conductive pad 44*b* have a gap 46*b* between them, as shown.

After providing the branchline coupler 18 and pair of partially formed phase adjusting sections 20*a*, 20*b*, as shown in FIG. 4, the partially formed phase adjusting sections 20*a*, 20*b* are completed in a process described below in connection with FIGS. 5A, 5B and 5C, suffice it to say here that conductive strips, or layers, 52*a*, 52*b* (FIGS. 5A and 5B), to be described, will be formed as conductive layers on the upper surface 15 of the substrate 12 as shown in FIG. 4, using additive manufacture, such as 3D printing or other conductive material deposition process, in the gaps 46*a*, 46*b* (FIG. 4) and on the opposing sidewalls 48*a*, 48*b* (FIG. 4) of pads 42*a*, 42*b*, respectively, and the opposing sidewalls 48*a*, 48*b* of pads, respectively; such strips having a length selected to provide a predetermined phase shift to a signal fed to input end 24 as such signal passing through the completed phase shifter 10 (FIG. 5B) to the output end 26, as shown in FIG. 4. More particularly, to complete the phase shifter 10' (FIG. 4) as will be described below in connection with FIGS. 5A, 5B and 5C the length of the conductive strip or layer 52*a*, 52*b* will have a length, L, L2 (FIGS. 5A and 5B, respectively) determined by a method to be described; suffice it to say here that the conductive strips or layers 52*a*, 52*b* (FIGS. 5A and 5B, respectively) will have a length, L, L2 selected to provide a predetermined phase shift to a signal passing between the input port or end 24 and the output port or end 26 in FIG. 4.

Figure 5A:
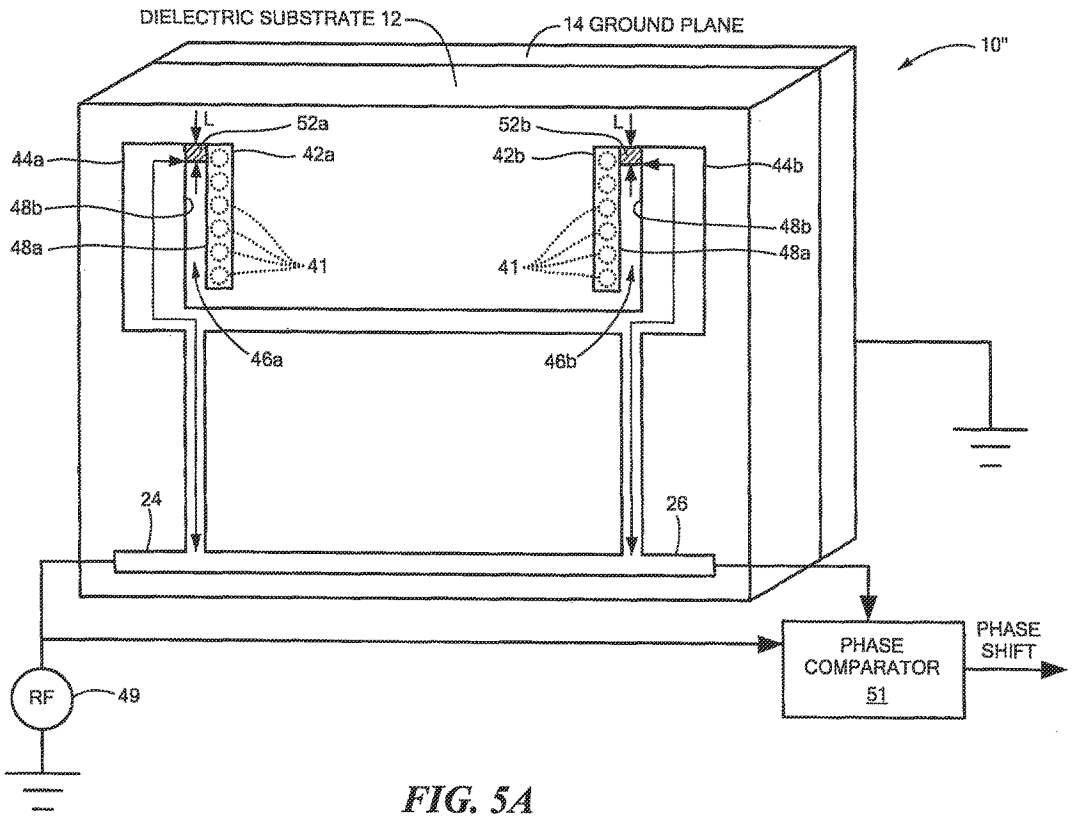
FIGS. 5A and 5B are perspective view sketch of the partially formed phase shifter of FIG. 4 at two additional stages in the fabrication thereof according to the disclosure.
Figure 5B:
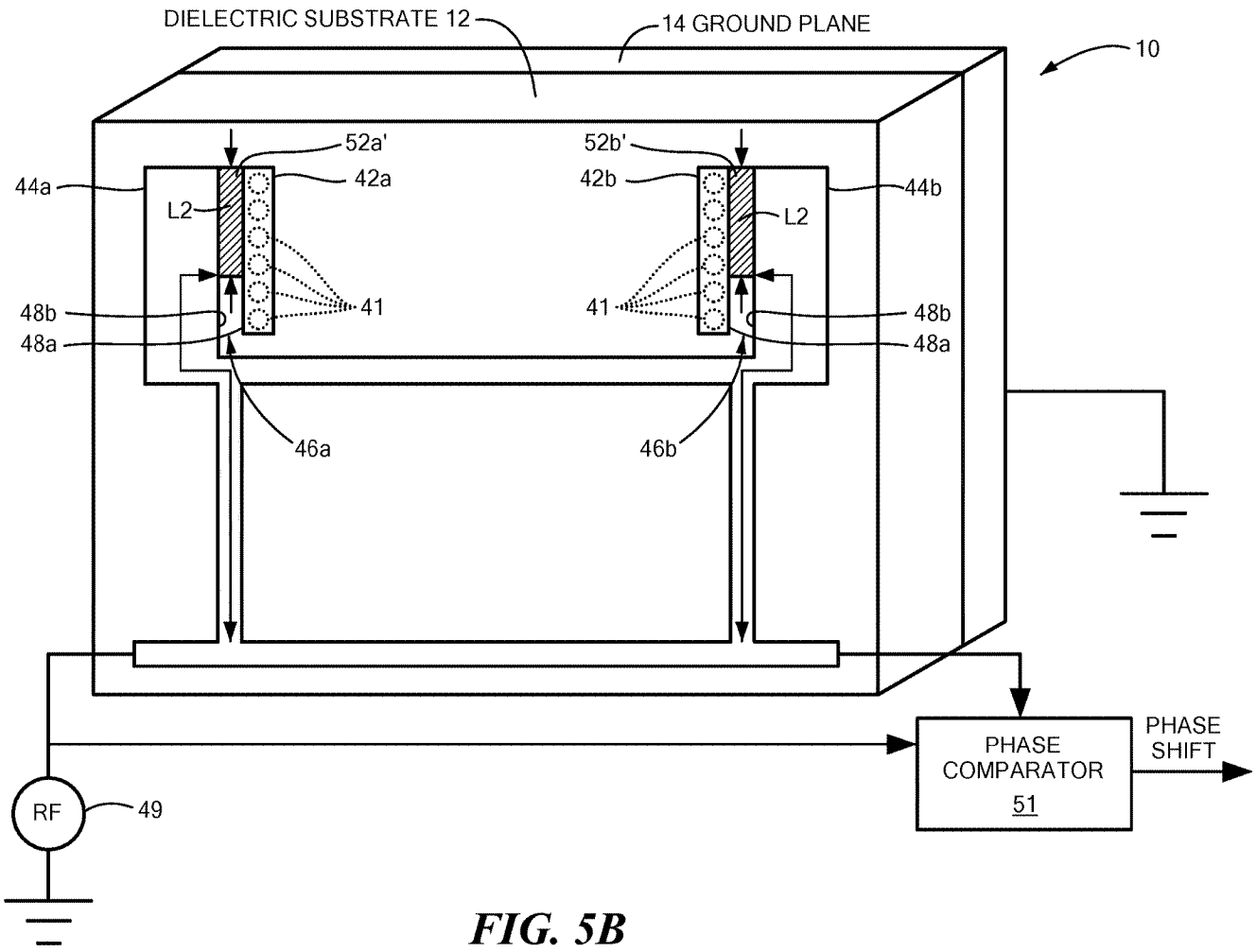
Figure 5C:
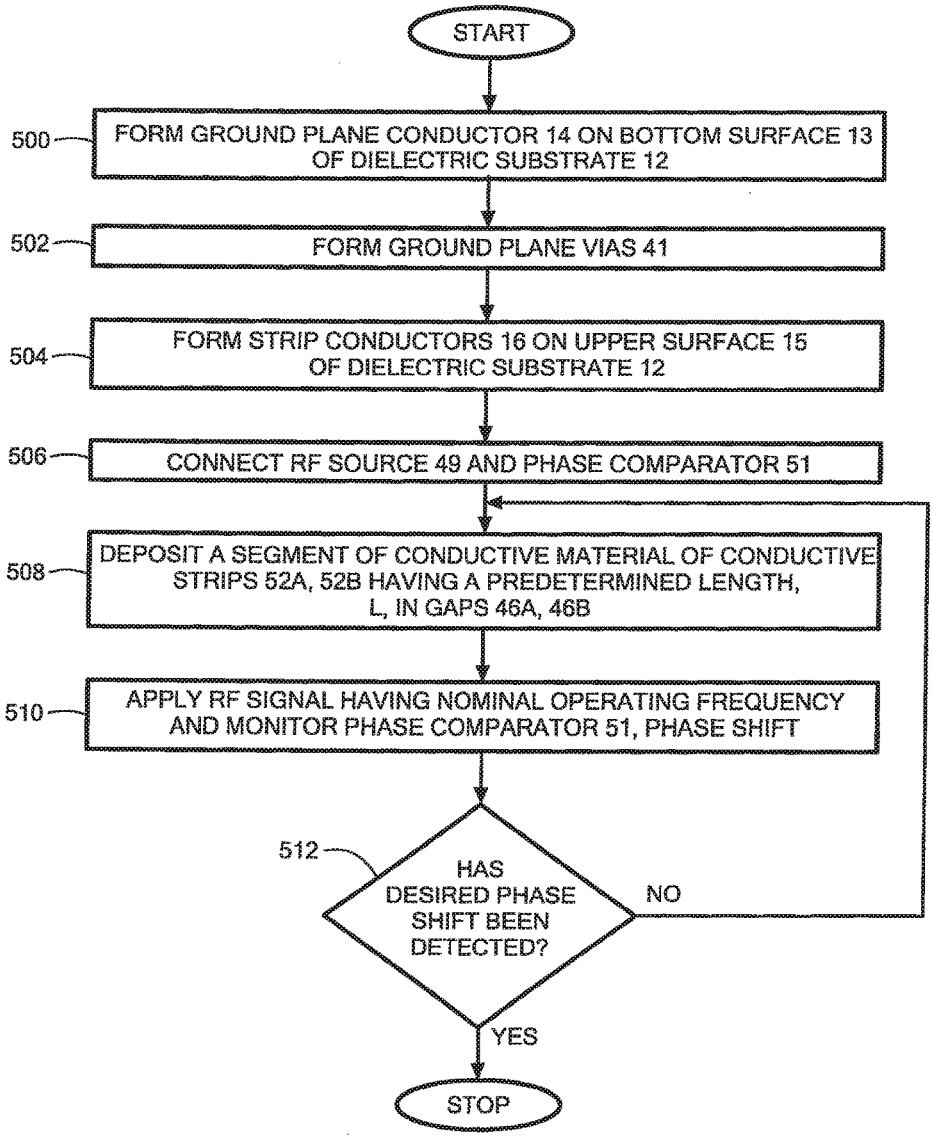
FIG. 5C is a flow diagram of a process used to in the fabrication of FIGS. 4, 5A and 5B to form a completed phase shifter according to the disclosure.

More particularly, and referring to FIGS. 5A, 5B and 5C, the method for completing the partially complete phase shifter 10' includes the steps of: (a) forming the partially formed phase shifter 10' (FIG. 4), steps 500, 502, and 504 (FIG. 5C); connect an input signal from an RF source 49 (FIG. 4) step 506 in FIG. 5C and a phase comparator 51 (FIGS. 4, 5A and 5B); (b) forming the conductive layers, or strips 52*a*, 52*b* (FIG. 5A) by depositing in the gaps 46*a*, 46*b*, a segment, of the conductive material, here for example, a conductive ink such as, for example Paru nanosilver PG-007, Paru, Co., Ltd Jeollanam-do, South Korea, on the upper surface 15 (FIG. 4) of the substrate 12 having a predetermined length, L, (FIG. 5A), the conductive layers 52*a*, 52*b* being a material different from the conductive pads 42*a*, 42*b*, the conductive layer 52*a*, 52*b* segment being electrically connected to the opposing sidewalls 48*a* of pads 42*a*, 42*b*, respectively, and the opposing sidewalls 48*b* of pads 44*a*, 44*b*(FIG. 5B). step 508 (FIG. 5C) to provide phase shifter 10" (FIG. 5A); (c) apply input signal at input end or port 24 from an RF source 49 (FIGS. 4, 5A and 5B) having nominal operating frequency and measure the output signal at output end of port 26 with phase comparator 51, step 510; (d) determining whether the measured phase shift PHASE SHIFT is the predetermined phase shift, step 512; if it is (i.e. YES), the process stops and the phase shifter 10 is completed; if not (i.e. NO), the process adds another segment of the conductive material having the predetermined length in the gaps 46*a*, 46*b* so that the length of the strips 52*a*, 52*b* are increased to strips 52*a*', 52*b*', now having a length an increased length, L2 (FIG. 5B), step 512 (FIG. 5C) and the process returns to step (d) (step 508 in FIG. 5C) until the measured phase shift (PHASE SHIFT) is the predetermined phase shift thereby producing the completed phase shift 10, as shown in FIG. 5B where here, in this example, the lengths of the strips producing the predetermined phase shift are L2; it being understood that in a typical case the final length L2 may be much greater than L (FIG. 5A).

At microwave frequencies, the wire bond solution typically has granularity of 10-15 degrees per wire bond. However, using the additive manufacturing (depositing or printing) described above, produces a much higher degree of granularity to the phase tuning capability of the shunt hybrid combiner technique. For example, segments having a length L of 2 mils create a 0.5 degree phase shift at upper C-Band frequencies. This compares to a 5-7 degree phase shift at C-Band frequencies from the above described prior wire bond solutions.

A number of embodiments of the disclosure have been described. Nevertheless, it will be understood that various modifications may be made without departing from the spirit and scope of the disclosure. For example, layouts and orientation may vary and still be within the spirit of the disclosure as well as the process of monitoring and adjusting the phase shift. Accordingly, other embodiments are within the scope of the following claims.

What is claimed is:

1. A method for forming a phase shifter, comprising:

providing a branchline coupler having a pair of phase adjusting sections, each one of the phase adjusting sections being coupled to a corresponding one of a pair of shunt transmission line sections of the branchline coupler, each one of the pair of phase adjusting sections comprising: first and second conductive pads disposed on an upper surface of a substrate, the first and second conductive pads having a gap there-between; one of the first and second conductive pads being connected to a ground plane conductor on a bottom surface of the substrate;

sequentially depositing in the gap a series of conductive layer segments on the upper surface of the substrate, the conductive layer segments being electrically connected to sidewalls of the first and second conductive pads;

measuring phase shift through the phase shifter after each one of the segments is deposited; and terminating the depositing process when the measuring detects a predetermined phase shift through the phase shifter.

2. The method recited in claim 1 wherein the depositing comprises using additive manufacturing.

3. A phase shifter, comprising:

a substrate having a ground plane conductor on a bottom surface thereof and strip conductors on an upper surface thereof, the strip conductors, substrate and ground plane conductor being arranged to form: a branchline coupler, comprising:

a main transmission line having an input end and an output end;

a pair of shunt transmission lines, one of the pair of shunt transmission lines having an input end connected to the input end of the main transmission line and the other of the pair of shunt transmission lines having an input end connected to the output end of the main transmission line;

an additional transmission line coupled between output ends of the pair of shunt transmission lines;

a pair of phase adjusting sections, each pair of phase shifting sections being coupled to the output end of a corresponding one of the pair of shunt transmission line sections, each one of the pair of phase adjusting sections comprising;

a first conductive pad disposed on the upper surface of the substrate and connected to the ground plane conductor;

a second conductive pad disposed on the upper surface of the substrate and connected to the output end of a corresponding one of the pair of shunt transmission line sections, the first conductive pad and the second conductive pad have a gap there-between; and a conductive layer disposed on the upper surface of the substrate in the gap and having sidewalls electrically connected to sidewalls of the first conductive pad and the second conductive pad, such conductive layer having a length selected to provide a predetermined phase shift to a signal passing between the input end and the output end.

4. A phase shifter, comprising:

a branchline coupler;

a pair of phase adjusting sections, each one of the pair of phase shifting sections, being coupled to a corresponding one of a pair of shunt transmission line sections of the branchline coupler, each one of the pair of phase adjusting sections comprising;

a first conductive pad disposed on the upper surface of a substrate of the branchline coupler and connected to a ground plane conductor on a bottom surface of the substrate;

a second conductive pad disposed on the upper surface of the substrate, the first conductive pad and the second conductive pad being separated by a gap; and a conductive layer disposed on the upper surface of the substrate in the gap and having sidewalls electrically connected to sidewalls of the first conductive pad and the second conductive pad, such conductive layer having a length selected to provide a predetermined phase shift to a signal passing between an input port and an output port; the conductive layer being a material different from the first conductive pad and the second conductive pad.

* * * * *